US012060768B2

(12) United States Patent
Inglis

(10) Patent No.: US 12,060,768 B2
(45) Date of Patent: Aug. 13, 2024

(54) PRESSURE-ACTIVATED VALVE ASSEMBLIES AND METHODS TO REMOTELY ACTIVATE A VALVE

(71) Applicant: Halliburton Energy Services, Inc., Houston, TX (US)

(72) Inventor: Peter D W Inglis, Dundee (GB)

(73) Assignee: HALLIBURTON ENERGY SERVICES, INC, Houston, TX (US)

( * ) Notice: Subject to any disclaimer, the term of this patent is extended or adjusted under 35 U.S.C. 154(b) by 352 days.

(21) Appl. No.: 17/566,580

(22) Filed: Dec. 30, 2021

(65) Prior Publication Data

US 2023/0212925 A1 Jul. 6, 2023

(51) Int. Cl.

| | |
|---|---|
| ***E21B 34/08*** | (2006.01) |
| ***E21B 34/10*** | (2006.01) |
| ***E21B 34/14*** | (2006.01) |
| ***E21B 47/06*** | (2012.01) |

(52) U.S. Cl.

CPC ..... *E21B 34/08* (2013.01); *E21B 34/10* (2013.01); *E21B 34/102* (2013.01); *E21B 34/14* (2013.01); *E21B 47/06* (2013.01); *E21B 2200/04* (2020.05)

(58) Field of Classification Search

CPC ..... E21B 34/08; E21B 34/10; E21B 34/102; E21B 34/14; E21B 47/06; E21B 2200/04

USPC ..... 251/61.2

See application file for complete search history.

(56) References Cited

U.S. PATENT DOCUMENTS 3,780,809 A * 12/1973 Ayers, Jr. ..... E21B 34/16 166/374

4,411,316 A 10/1983 Carmody 4,624,315 A * 11/1986 Dickson ..... E21B 34/102 166/323

4,723,606 A * 2/1988 Vinzant ..... E21B 34/102 166/332.1

4,796,699 A * 1/1989 Upchurch ..... E21B 41/00 166/264

(Continued)

FOREIGN PATENT DOCUMENTS

| | | |
|---|---|---|
| EP | 1190156 B1 | 6/2003 |
| WO | 2020117226 A1 | 6/2020 |
| WO | 2021168032 A1 | 8/2021 |

OTHER PUBLICATIONS

International Search Report and Written Opinion issued Sep. 26, 2022 in PCT/US2022/011490 (10 pages).

*Primary Examiner* — William M McCalister

(74) *Attorney, Agent, or Firm* — Barnes & Thornburg LLP

(57) ABSTRACT

Pressure-activated valve assemblies and methods to remotely activate a valve are disclosed. A pressure-activated valve assembly includes a valve, a latch mechanism configured to shift the valve to an open position, and a pressure-activated indexing mechanism that is initially engaged to the latch mechanism. The pressure-activated indexing mechanism is initially in an unarmed mode. After the pressure-activated indexing mechanism is in an armed mode, applying at least one cycle of threshold pressure to the pressure-activated indexing mechanism disengages the latch mechanism to shift the valve to the open position. The pressure-activated valve assembly also includes a remote-activated downhole system configured to receive an activation pressure signal having a signature profile, and in response to receiving the activation pressure signal, arm the pressure-activated indexing mechanism.

20 Claims, 6 Drawing Sheets

(56) References Cited

U.S. PATENT DOCUMENTS 4,971,160 A * 11/1990 Upchurch ..... E21B 41/00 175/4.54
5,234,057 A * 8/1993 Schultz ..... E21B 49/0815 702/6
5,343,963 A * 9/1994 Bouldin ..... E21B 23/042 175/38
5,355,960 A * 10/1994 Schultz ..... E21B 34/16 166/374
5,490,564 A 2/1996 Schultz et al.
6,237,683 B1 * 5/2001 Pringle ..... E21B 21/10 166/240
6,338,466 B1 * 1/2002 Wallace ..... E21B 34/102 251/324
7,145,471 B2 * 12/2006 Purkis ..... E21B 34/16 166/336
8,322,426 B2 12/2012 Wright et al.
10,597,960 B2 * 3/2020 Solem ..... E21B 23/00
10,662,736 B2 5/2020 Murphy et al.
10,808,523 B2 * 10/2020 Fripp ..... E21B 33/10
10,907,471 B2 * 2/2021 Fripp ..... E21B 47/138
2003/0178198 A1 9/2003 Turner et al.
2003/0213595 A1 * 11/2003 Jackson ..... E21B 43/119 166/66
2011/0168390 A1 * 7/2011 Fripp ..... E21B 47/017 166/250.07
2015/0167427 A1 * 6/2015 Simpson ..... E21B 34/102 166/374
2015/0292281 A1 * 10/2015 Hardin, Jr. ..... E21B 23/006 175/267
2016/0230520 A1 * 8/2016 Steele ..... F16K 31/426
2017/0016292 A1 * 1/2017 Solem ..... E21B 47/00
2018/0038201 A1 * 2/2018 Evans ..... E21B 10/322
2019/0085654 A1 * 3/2019 Singh ..... E21B 47/18
2023/0212925 A1 * 7/2023 Inglis ..... E21B 34/08 175/25

* cited by examiner

PRESSURE-ACTIVATED VALVE ASSEMBLIES AND METHODS TO REMOTELY ACTIVATE A VALVE

The present disclosure relates generally to pressure-activated valve assemblies and methods to remotely activate a valve.

Wellbores are sometimes drilled into subterranean formations to allow for the extraction of hydrocarbons and other materials. Valves are sometimes disposed in a wellbore and are utilized during one or more well operations to restrict fluid flow through the wellbore.

BRIEF DESCRIPTION OF THE DRAWINGS

Illustrative embodiments of the present disclosure are described in detail below with reference to the attached drawing figures, which are incorporated by reference herein, and wherein.

Figure 1:
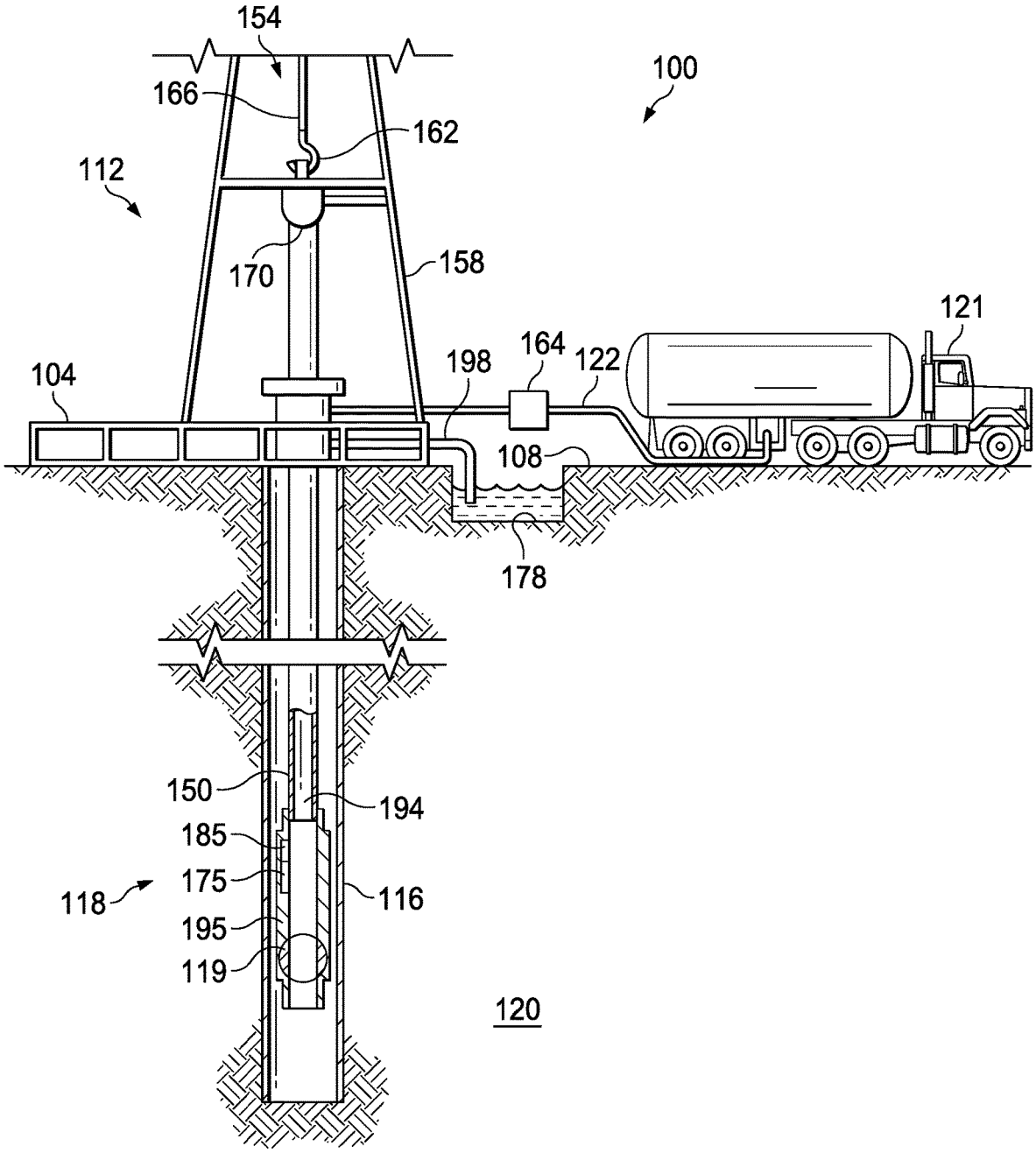
FIG. 1 is a schematic, side view of a completion environment in which a pressure-activated valve assembly is deployed in a wellbore.

The illustrated figures are only exemplary and are not intended to assert or imply any limitation with regard to the environment, architecture, design, or process in which different embodiments may be implemented.

DETAILED DESCRIPTION

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

The present disclosure relates to pressure-activated valve assemblies and methods to remotely activate a valve. A pressure-activated valve assembly includes a valve that is shiftable, rotatable, or moveable from a first position (open position), in which the valve provides fluid flow through the valve, to a second position (closed position), in which the valve reduces or restricts fluid flow through the valve, and from the closed position to the open position. Examples of valves include, but are not limited to, ball valves, sleeves, circulation valves, tester valves, and other types of valves.

The pressure-activated valve assembly also includes a latch mechanism that is configured to shift the valve from a closed position to an open position. In some embodiments, the latch mechanism includes a latch and a spring that is initially in a compressed state while the latch is engaged (such as engaged to a pressure-activated indexing mechanism component of the pressure-activated valve assembly). After the latch is disengaged, the spring returns to a natural state, and the force of the spring returning to the natural state shifts the ball valve to the open position. In one or more of such embodiments, the force generated by the spring is applied to another component, such as a rod, mandrel, tubular, or another component that is coupled to the valve, thereby causing the other component to shift, rotate, or move the valve to the open position. Additional descriptions of the latch mechanism are provided herein and are illustrated in at least FIGS. 2A-2B.

The pressure-activated valve assembly also includes a remote-activated downhole system that is configured to receive an activation pressure signal that has a specific signature profile. In some embodiments, the remote-activated downhole system includes a sensor that is configured to detect pressure signals. In some embodiments, the remote-activated downhole system also includes a detector that is configured to compare signatures of the detected pressure signals and determine whether the signature profiles of any of the detected signals match the signature profile of the activation pressure signal. In some embodiments, the remote-activated downhole system also includes a chamber that is partially or completely filled with an actuator fluid, a fluid barrier that initially prevents the actuator fluid from flowing through the fluid barrier while the fluid barrier is intact, and an actuation mechanism that is configured to move from a first position to a second position to puncture the fluid barrier. As referred to herein, an actuation mechanism is any component or device that is configured to shift from a first position to a second position to puncture, break, or induce failure of the fluid barrier. Examples of actuation mechanisms include, but are not limited to pins, rods, protrusions, screws, and other types of components or devices that are configured to shift from the first position to the second position to puncture, break, or induce failure of the fluid barrier. In one or more of such embodiments, and in response to a determination (e.g., by the detector or another component of the remote-activated downhole system) that the signature profile of a detected pressure signal matches the signal profile of an activation pressure signal, the actuation mechanism is actuated or shifted from the first position to the second position to puncture, break, or induce failure of the fluid barrier.

In some embodiments, the remote-activated downhole system also includes a piston that is positioned in a first position while the fluid barrier is intact, and shifts to a second position after the fluid barrier is punctured, breaks, or fails. In one or more of such embodiments, remote-activated downhole system arms a pressure-activated indexing mechanism as the piston shifts from the first position to the second position, or after the position shifts from the first position to the second position. In one or more of such embodiments, the piston prevents a threshold of pressure from being generated to disengage the latch mechanism while the piston is in the first position. In one or more of such embodiments, the piston prevents pressure or differential pressure from being applied to a piston of the pressure-activated indexing mechanism to disengage the latch mechanism while the piston is in the first position. Additional descriptions of operations to shift the piston of the remote-activated downhole system to arm the Pressure Activated Indexing Mechanism and the pressure-activated valve assembly are provided herein and are illustrated in at least FIGS. 3A-3B. Additional descriptions of the remote-activated downhole system are provided herein and are illustrated in at least FIGS. 3A-3B.

As referred to herein, the pressure-activated indexing mechanism is an indexing mechanism that counts the number of cycles of threshold pressure applied to the pressure-activated indexing mechanism or a component (such as a piston) of the pressure-activated indexing mechanism. The pressure-activated indexing system is initially in an unarmed mode. In some embodiments, ports through which pressure or differential pressure is applied to the pressure-activated indexing mechanism or one or more components of the pressure-activated indexing mechanism (e.g., a piston) to disengage the latch mechanism are blocked to prevent pre-mature disengagement of the latch mechanism. After the pressure-activated indexing mechanism is armed, the pressure-activated indexing mechanism counts the number of cycles of threshold pressure applied to the pressure-activated indexing mechanism or a component of the pressure-activated indexing mechanism until the number of cycles of threshold pressure is equal to a threshold number of cycles, after which, the pressure-activated indexing mechanism disengages from the latch mechanism or causes the latch mechanism to disengage, thereby shifting the valve to the open position. As referred to herein, a cycle of threshold pressure is when pressure applied to the pressure-activated indexing mechanism or to a component of the pressure-activated indexing mechanism is equal to or greater than the threshold pressure for at least a threshold period of time. Further, the pressure-activated indexing mechanism is configured such that after the threshold number of cycles of threshold pressure are applied to the pressure-activated indexing mechanism, the pressure-activated indexing mechanism disengages from the latch mechanism or causes the latch mechanism to disengage, which in turn shifts the valve to the open position. In some embodiments, the pressure-activated indexing mechanism includes an indexing piston that is configured to shift from a first position to a second position in response to the threshold amount of pressure being applied to the indexing piston, and shift from the second position to the first position if less than the threshold amount of pressure is applied to the indexing piston. In some embodiments, shifting the piston from the first position to the second position for a threshold number of times that equals to the threshold number of cycles disengages the latch mechanism or causes the latch mechanism to disengage from the pressure-activated indexing system. In some embodiments, the pressure-activated indexing system includes a first chamber and a second chamber, where fluid in the first chamber has a first pressure and fluid in the second chamber has a second pressure that is higher than the first pressure. In such embodiments, fluid in the two chambers apply a differential pressure that is at least the threshold pressure to shift the piston from the first position to the second position. Additional descriptions of the pressure-activated indexing mechanism and components of the pressure-activated indexing mechanism are described herein and are illustrated in at least FIGS. 2A-2B. Further, additional descriptions of the pressure-activated valve assembly, methods to produce differential flow rate though ports of pressure-activated valve assemblies, and methods to reduce proppant flow back are provided in the paragraphs below and are illustrated in FIGS. 1-5.

Turning now to the figures, FIG. 1 is a schematic, side view of a completion environment 100 where a pressure-activated valve assembly 118 having a ball valve 119, a remote-activated downhole system 175, a pressure-activated indexing mechanism 185, and a latch mechanism 195 is deployed in a wellbore 116 of a well 112. As shown in FIG. 1, wellbore 116 extends from surface 108 of well 112 to a subterranean substrate or formation 120. Well 112 and rig 104 are illustrated onshore in FIG. 1. Alternatively, the operations described herein and are illustrated in the figures are performed in an off-shore environment. In the embodiment illustrated in FIG. 1, wellbore 116 has been formed by a drilling process in which dirt, rock and other subterranean materials are removed to create wellbore 116. In some embodiments, a portion of wellbore 116 is cased with a casing. In other embodiments, wellbore 116 is maintained in an open-hole configuration without casing. The embodiments described herein are applicable to either cased or open-hole configurations of wellbore 116, or a combination of cased and open-hole configurations in a particular wellbore.

After drilling of wellbore 116 is complete and the associated drill bit and drill string are "tripped" from wellbore 116, a tubular 150 is lowered into wellbore 116. In the embodiment of FIG. 1, tubular 150 is lowered by a lift assembly 154 associated with a derrick 158 positioned on or adjacent to rig 104 as shown in FIG. 1. Lift assembly 154 includes a hook 162, a cable 166, a traveling block (not shown), and a hoist (not shown) that cooperatively work together to lift or lower a swivel 170 that is coupled to an upper end of tubular 150. In some embodiments, tubular 150 is raised or lowered as needed to add additional sections to tubular 150 and to run tubular 150 across a desired number of zones of wellbore 116.

An inlet conduit 122 is coupled to a fluid source 121 and a pump 164 to provide fluids to an interior passageway 194 of tubular 150 that provides a passageway for fluids and solid particles to flow downhole. As referred to herein, downhole refers to a direction along tubular 150 that is away from the surface end of tubular 150, whereas uphole refers to a direction along tubular 150 that is towards the surface end of tubular 150. While a ball valve 119 of pressure-activated valve assembly 118 is in an open position, fluids flowing through interior passageway 194, also flows through and out of pressure-activated valve assembly 118. In some embodiments, while ball valve 119 is in the open position, interior passageway 194 also provides a fluid passageway for a fluid to flow uphole, where the fluid eventually flows into an outlet conduit 198, and from outlet conduit 198 into a container 178. In some embodiments, tubular 150 also provides a fluid flow path for fluids to flow into one or more cross-over ports (not shown) that provide fluid flow around (such as up and/or below) pressure-activated valve assembly 118. In some embodiments, one or more pumps (not shown) are utilized to facilitate fluid flow downhole or uphole, and to generate pressure downhole or uphole.

In the embodiment of FIG. 1, pump 164, in addition to facilitating fluid flow downhole, also generates various acoustic or time dependent pressure profiles. Pressure-activated valve assembly 118 has a remote-activated downhole system 175 that is configured to detect pressure signals, such as pressure signals generated by pump 164, determine whether any pressure signal has a signature profile that matches the signature profile of an activation pressure signal, and in response to a determination that the signature profile of the pressure signal matches the signature profile of the activation pressure signal, arm pressure-activated indexing mechanism 185. Once pressure-activated indexing mechanism 185 is in arm mode, a threshold number of cycles of threshold pressure are applied to pressure-activated indexing mechanism 185 to disengage latch mechanism 195, which in turn shifts ball valve 119 to an open position. In some embodiments, after pressure-activated indexing mechanism 185 is in arm mode, a single cycle of threshold pressure is applied to pressure-activated indexing mechanism 185 to disengage latch mechanism 195 from pressure-activated indexing mechanism 185. In some embodiments, multiple cycles of threshold pressure are applied to pressure-activated indexing mechanism 185 to disengage latch mechanism 195 from pressure-activated indexing mechanism 185. Additional descriptions of remote-activated downhole system 175, pressure-activated indexing mechanism 185, and latch mechanism 195 and their corresponding components are provided herein and are illustrated in at least FIGS. 2 and 3.

Although FIG. 1 illustrates a single pressure-activated valve assembly 118, in some embodiments, multiple pressure-activated valve assemblies are deployed (not shown) in different sections of wellbore 116. Further, although FIG. 1 illustrates a ball valve 119, in some embodiments, pressure-activated valve assembly 118 has a different valve, sleeves (not shown), or multiple valves (not shown). Further, although FIG. 1 illustrates a surface-based pump 164, in some embodiments, pump 164 is deployed downhole. In some embodiments, multiple pumps (not shown) are deployed to facilitate fluid flow, fluid circulation, and to generate an activation pressure signal. Further, although FIG. 1 illustrates a completion environment, it is understood that pressure-activated valve assembly 118 and other pressure-activated valve assemblies described herein are deployable in other well environments and well operations, including, but not limited to drilling operations, intervention operations, MWD/LWD operations, as well as other types of well environments and operations.

Figure 2A:
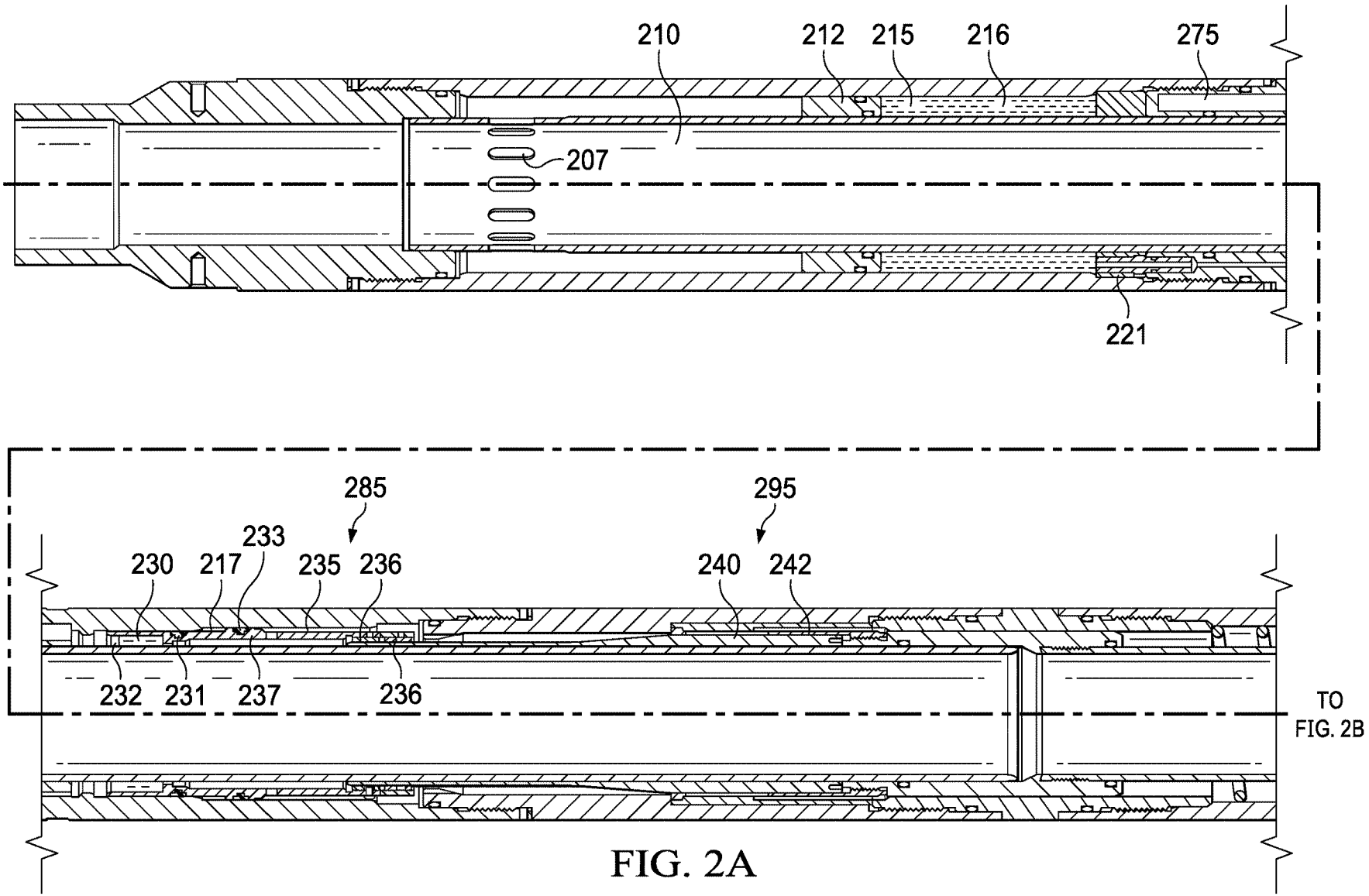
FIGS. 2A and 2B is a schematic, cross-sectional view of a pressure-activated valve assembly that is similar to the pressure-activated valve assembly of FIG. 1 and deployable in the wellbore of FIG. 1.
Figure 2B:
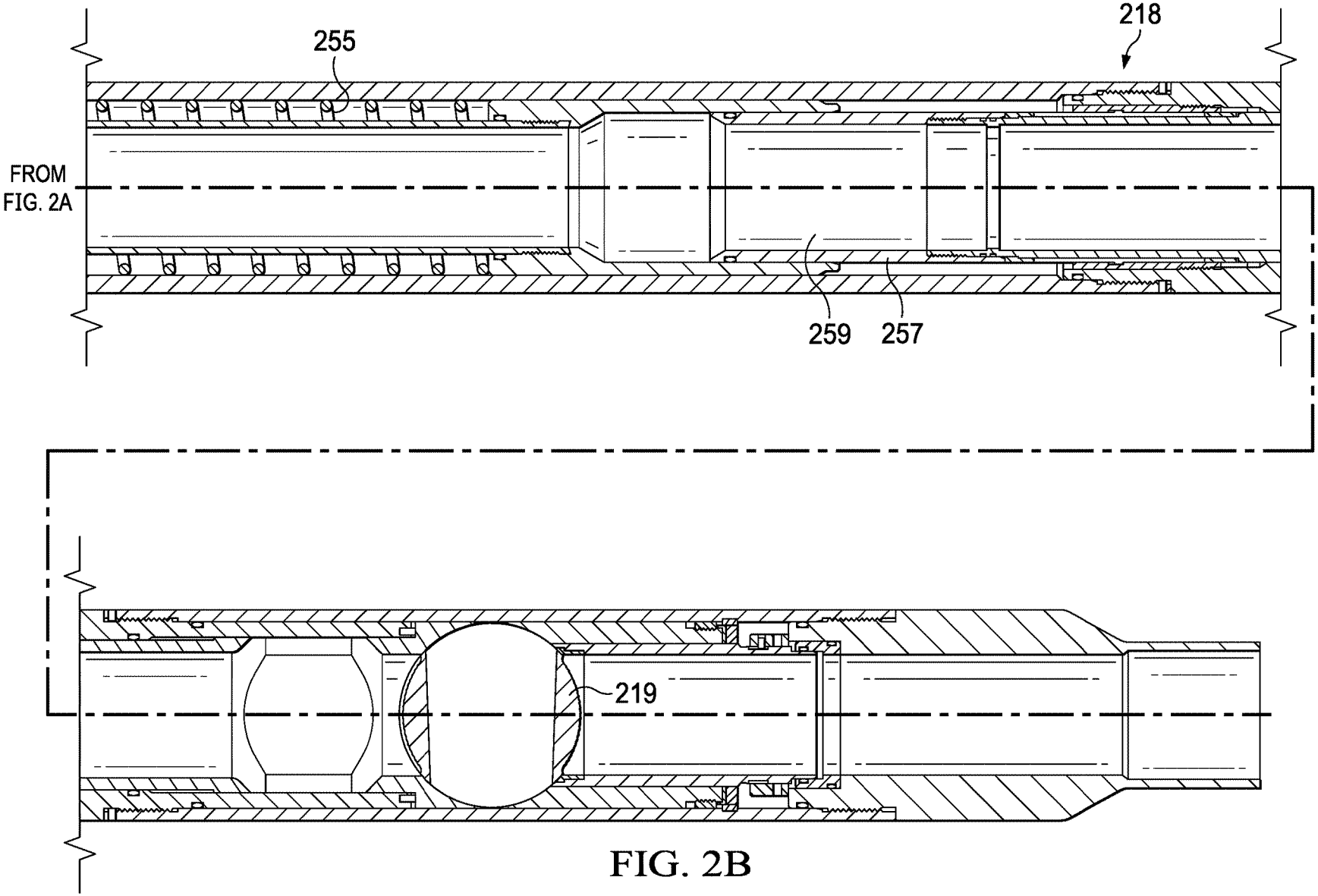

FIGS. 2A-2B are schematic, cross-sectional views of a pressure-activated valve assembly 218 that is similar to the pressure-activated valve assembly of FIG. 1 and deployable in the wellbore 116 of FIG. 1. In the embodiment of FIGS. 2A-2B, pressure-activated valve assembly 218 includes a remote-activated downhole system 275, a pressure-activated indexing mechanism 285, and a latch mechanism 295. Additional descriptions of components of remote-activated downhole system 275 and operations performed by remote-activated downhole system 275 to arm pressure-activated indexing mechanism 285 are described herein and are illustrated in at least FIGS. 3-6.

Pressure-activated valve assembly 218 has a bore 210 and a piston 212 that is positioned in the sidewall of pressure-activated valve assembly 218. Pressure flowing through bore 210 also flow through opening 207 to apply pressure to piston 212. In some embodiments, pressure-activated valve assembly 218 also includes a filter that is positioned along a sidewall of pressure-activated valve assembly 218. In one or more of such embodiments, pressure flowing through bore 210 also flow through opening 207 and the filter to apply pressure to piston 212. Piston 212 is positioned adjacent to a low-pressure chamber 215 that is partially or completely filled with a compressible fluid 216 such as silicon oil. In the embodiment of FIGS. 2A-2B, low-pressure chamber 215 also extends to a region 217 that is between seals 231 and 233. In one or more of such embodiments, a port (not shown) fluidly connects region 217 of low-pressure chamber 215 with the other regions of low-pressure chamber 215. Further, in the embodiment of FIGS. 2A-2B, the compressible fluid also partially or completely fills high-pressure chamber 230 of pressure-activated valve assembly 218 and along annular regions in the sidewall of pressure-activated valve assembly 218. Pressure (such as fluid pressure) applied by piston 212 as piston 212 shifts from a first position to a second position flows into region 217. Pressure applied by piston 212 also flows through a check valve 221 into high-pressure chamber 230. In the embodiment of FIGS. 2A-2B, check valve 221 is a valve that permits fluid and pressure to flow into high-pressure chamber 230 but restricts fluid and pressure flow out of high-pressure chamber 230 such that fluid or pressure flow out check valve 221 at a rate that is less than a threshold rate to induce a pressure differential. In some embodiments, check valve 221 includes or is coupled to a restrictor (not shown) that prevents or reduces fluid and pressure flow out of high-pressure chamber 230. In that regard, when pressure in low-pressure chamber 215 is reduced, such as by shifting piston 212 back to the first position, pressure in low-pressure chamber 215 which includes region 217 is reduced. However, pressure across high-pressure chamber 230 is prevented by check valve 221 from being reduced or from being reduced at the same rate as the rate pressure in low-pressure chamber 215 is reduced, thereby creating a pressure differential across an indexing piston 237 of pressure-activated indexing mechanism 285 that is positioned adjacent to region 217 of low-pressure chamber 215 and high-pressure chamber 230. The pressure-differential across region 217 of low-pressure chamber 215 and high-pressure chamber 230 in turn applies a pressure or differential pressure to indexing piston 237. In the embodiment of FIGS. 2A-2B, indexing piston is shifted from the first position illustrated in FIGS. 2A-2B to a second position (not show) to the left of the position illustrated in FIGS. 2A-2B in response to a threshold amount of pressure or differential pressure being applied by the pressure or pressure differential across region 217 of low-pressure chamber 215 and high-pressure chamber 230. In one or more of such embodiments, indexing piston 237 shifts from the first position to the second position after the threshold pressure or differential pressure is applied for a threshold period of time (e.g., one second, five seconds, ten seconds, or a different period of time). Indexing piston 237 also applies a force to a spring 232 that is positioned in high-pressure chamber 230, thereby compressing the spring 232.

Over time (e.g., one hour, five hours, ten hours, or another period of time), pressure in high-pressure chamber 230 slowly flow or bleed out of high-pressure chamber 230 through a restrictor (not shown), and into low-pressure chamber 215, thereby reducing the pressure or pressure differential across region 217 of low-pressure chamber 215 and high-pressure chamber 230. As the pressure or pressure differential across region 217 of low-pressure chamber 215 and high-pressure chamber 230 reduces below a threshold, the potential energy stored in the compressed state of spring 232 is released, which in turn shifts indexing piston 237 from the second position back to the first position. In some embodiments, applying additional pressure to region 217 of low-pressure chamber 215 reduces the pressure differential across region 217 of low-pressure chamber 215 and high-pressure chamber 230 below the threshold. In such embodiments, the potential energy stored in the compressed state of spring 232 is released, which in turn shifts indexing piston 237 from the second position back to the first position.

Indexing piston 237 is coupled to an indexing mandrel 240 such that each time indexing piston 237 shifts from the first position to the second position, indexing piston 237 pulls indexing mandrel 240 through one or more lock rings 236 to shift indexing mandrel 240 by an increment to the left. Moreover, lock rings 236 are configured such that when indexing piston 237 shifts from the second position back to the first position, one or more of lock rings 236 prevent indexing mandrel 240 from being shifted by one increment to the right and to its previous position. Moreover, indexing mandrel 240 moves an additional increment to the left after each pressure cycle described herein, where a threshold pressure or pressure differential is applied to indexing piston 237 for a threshold period of time per cycle. In the embodiment of FIGS. 2A-2B, indexing mandrel 240 is coupled to a latch 242. Further, applying a threshold number of pressure cycles (e.g., one cycle, two cycles, five cycles, or a different number of cycles of threshold pressure or pressure differential) to indexing piston 237 shifts indexing mandrel 240 by the threshold number of increments to disengage latch 242. Latch 242 is coupled to a spring 255 that is in a compressed state while latch 242 is engaged to indexing mandrel 240. After latch 242 disengages from indexing mandrel 240, thereby permitting spring 255 to return to a natural state. Further the force released by spring 255 in turn shifts mandrel 257 (or a profiled portion 259 of mandrel 257) from a first position illustrated in FIGS. 2A-2B to a second position (not shown) to the left of the first position of mandrel 257. Mandrel 257 in turn shifts a ball 219 of pressure-activated valve assembly 218 from a closed position illustrated in FIGS. 2A-2B to an open position (not shown) as mandrel 257 shifts from the first position to the second position, thereby opening pressure-activated valve assembly 218. In some embodiments, spring 255 is coupled to mandrel 257 such that mandrel 257 (or profile section 259 of mandrel) is shifted from the first position to the second position as spring 255 returns to its natural state.

In the embodiment of FIGS. 2A-2B, low-pressure chamber pressure-activated indexing mechanism 285 includes low-pressure chamber 215, check valve 221, high-pressure chamber 230, lock rings 236, indexing piston 237, and indexing mandrel 240 are components of pressure-activated indexing mechanism 285. In some embodiments, pressure-activated indexing mechanism 285 includes different components of pressure-activated valve assembly 218. Further, in the embodiment of FIGS. 2A-2B, latch mechanism 295 includes latch 242, spring 255, and mandrel 257. In some embodiments, latch mechanism includes different components of pressure-activated valve assembly 218. Further, although the above paragraphs describe performing operations by components of pressure-activated valve assembly 218 to shift ball 219 to an open position, it is understood that where ball 219 is initially in an open position, similar or identical operations as the operations described herein may also be performed to shift ball 219 from the open position to the closed position.

Figure 3A:
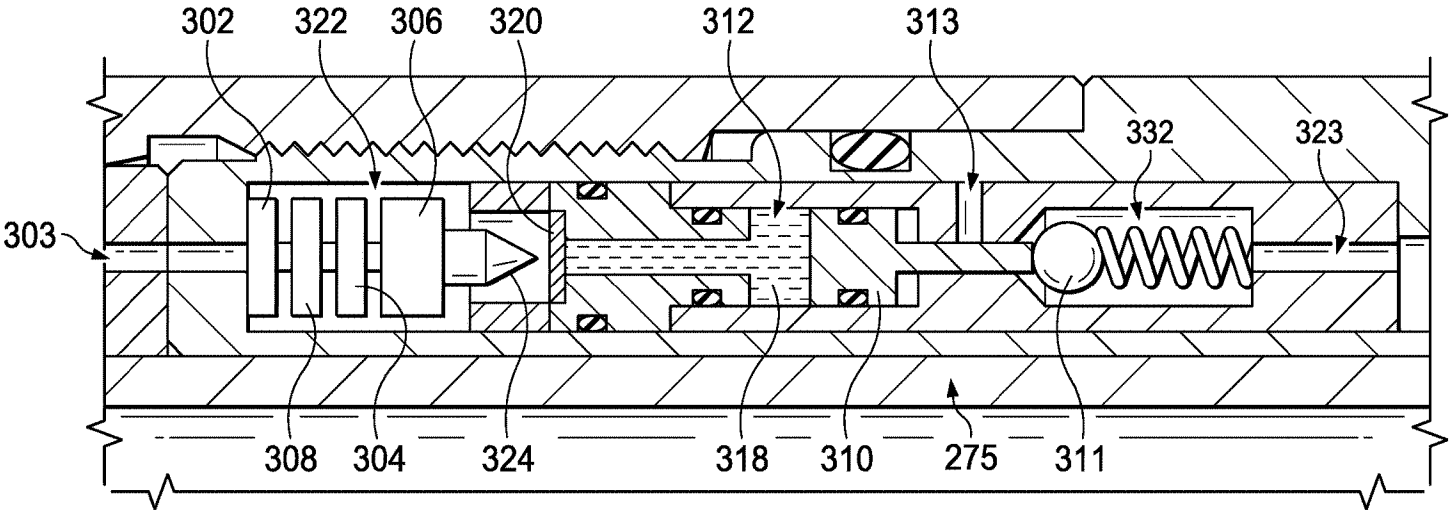
FIG. 3A is a schematic, cross-sectional view of a remote-activated downhole system of the pressure-activated valve assemblies of FIGS. 1, 2A, and 2B before the remote-activated downhole system is activated.

FIG. 3A is a schematic, cross-sectional view of a remote-activated downhole system 275 of pressure-activated valve assemblies 118 and 218 of FIGS. 1, 2A, and 2B before remote-activated downhole system 275 is activated. In the embodiment of FIG. 3A, remote-activated downhole system 275 is housed in a sidewall of the pressure-activated valve assembly and includes a receiver such as pressure sensor 302 in fluid communication with an interior passageway of the pressure-activated valve assembly by a pressure port 303. In some embodiments, pressure port 303 provides pressure and fluid communication with bore 210 of FIGS. 2A-2B. The pressure sensor 302 is operable to monitor a pressure within the interior passageway and provide pressure values of the fluid within the interior passageway to a decoder 304. Decoder 304 is operable to compare the pressure values received from the pressure sensor 302 with a predetermined signature profile indicative of a request to arm the pressure-activated valve assembly. In some embodiments, decoder 304 is an electronic circuit including various components such as a microprocessor, a digital signal processor, random access member, read only member and the like that are programmed or otherwise operable to recognize the predetermined signature profile and determine whether to arm the pressure-activated valve assembly. When decoder 304 identifies a match between the pressure values received and the signature profile, decoder 304 issues a request to an actuation mechanism, such as pin pusher 306. In some embodiments, pin pusher 306 has a linear motor, pneumatic piston, or similar mechanism. In some embodiments, decoder 304 also has timing devices to delay or control the time period between detection of the signature profile and issuing the request to pin pusher 306. In some embodiments, pressure sensor 302, decoder 304 and pin pusher 306 are all operably coupled to a battery 308 or another downhole power source to receive power.

Slidably and sealingly disposed within the sidewall of the pressure-activated valve assembly is a piston 310 that initially prevents ball 311 from coming in contact with seat 333 thus maintaining open communication between pressure ports 313 and 323 that provide a fluid and pressure passageway to a pressure-activated indexing mechanism of the pressure-activated valve assembly, such as region 217 of low-pressure chamber 215 and high-pressure chamber 230 of pressure-activated indexing mechanism 285 of FIGS. 2A-2B. Piston 310 may initially be coupled to or provide support for ball 311 that is positioned in a third chamber 332 that is fluidly connected to a pressure-activated indexing mechanism of the pressure-activated valve assembly, such as high-pressure chamber 230 of pressure-activated indexing mechanism 285 of FIGS. 2A-2B via pressure port 323. Initially, displacement of piston 310 toward fluid chamber 312 is substantially prevented by an actuator fluid 318 disposed within fluid chamber 312. In some embodiments, actuator fluid 318 is a non-compressible or a substantially incompressible fluid, such as a hydraulic fluid. In some embodiments, actuator fluid 318 is a compressible fluid such as nitrogen, a combination of substantially incompressible fluids, a combination of compressible fluids or a combination of one or more compressible fluids with one or more substantially incompressible fluids.

A fluid barrier 320 is secured between fluid chamber 312 and a second chamber 322, in which pin pusher 306 is disposed. Fluid barrier 320 initially prevents actuator fluid 318 from escaping from fluid chamber 312 into second chamber 322. Chamber 322 is empty of or essentially empty of fluid other than air or another gas at atmospheric pressure. Fluid barrier 320 is illustrated as a disk member and is formed from a metal. In some embodiments, fluid barrier 320 is formed from a plastic, a composite, a glass, a ceramic, a mixture of these materials, or other material suitable for initially containing actuator fluid 318 in fluid chamber 312, but selectively failing in response to the signature profile being identified by the decoder 304, and the request being issued to pin pusher 306. In the illustrated embodiment, pin pusher 306 advances a pin 324 in second chamber 322 toward fluid barrier 320 to thereby puncture, break, or fracture fluid barrier 320. In other embodiments, failure of fluid barrier 320 is selectively induced by other types of actuation mechanisms configured to induce failure of fluid barrier 320 by chemical reactions, combustion, mechanical weakening or other degradation of fluid barrier 320.

During operation, pressure sensor 302 detects the pressure in the interior passageway and provides pressure values to decoder 304 over time. Decoder 304 monitors the pressure values, and determines whether the pressure values over a particular time interval match the signature profile saved in decoder 304. If decoder 304 identifies the pressure profile in the pressure values received, and determines that the pressure-activated valve assembly should be armed, decoder 304 issues a request to pin pusher 306 to advance pin 324 to puncture, break, or induce failure of fluid barrier 320, thereby arming pressure-activated valve assembly 218 of FIGS. 2A-2B. In some embodiments, decoder 304 routes electrical power from battery 308 to pin pusher 304, immediately or after an appropriate delay, to allow pin pusher 306 to operate to induce a failure of fluid barrier 320.

Figure 3B:
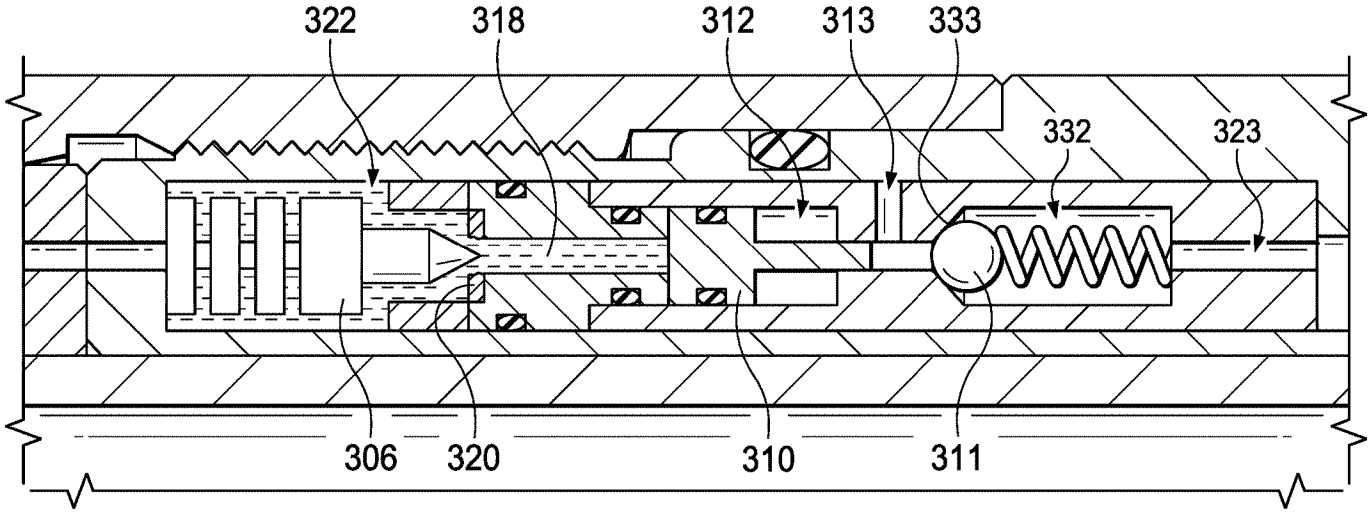
FIG. 3B is a schematic, cross-sectional view of the remote-activated downhole system of FIG. 3A after the remote-activated downhole system is activated.

FIG. 3B is a schematic, cross-sectional view of remote-activated downhole system 275 of FIG. 3A after remote-activated downhole system 275 is activated. In the embodiment of FIG. 3B pin pusher 306 has shifted from the position illustrated in FIG. 3A to the position illustrated in FIG. 3B to induce failure of barrier 320. Failure of barrier 320 creates an opening in fluid barrier 320 and establishes fluid communication between fluid chamber 312 and second chamber 322. In some embodiments, actuator fluid 318 flows from fluid chamber 312 into second chamber 322, which allows piston 310 to shift toward fluid chamber 312). Further, the failure of barrier 320 and flow of actuator fluid 318 from fluid chamber 312 into second chamber 322 in turn induces piston 310 to shift from the position illustrated in FIG. 3A to the position illustrated in FIG. 3B, thereby permitting communication between fluid chamber 312 and region 217 of low-pressure chamber 215 via pressure port 313. The shifting of piston 310 from the position illustrated in FIG. 3A to the position illustrated in FIG. 3B allows ball 311 to move from the position illustrated in FIG. 3A to the position illustrated in FIG. 3B. In one or more of such embodiments, piston 310 initially holds ball 311 in the position illustrated in FIG. 3A (or prevents ball 311 to move to the position illustrated in FIG. 3B) until piston 310 shifts from the position illustrated in FIG. 3A to the position illustrated in FIG. 3B. In one or more of such embodiments, ball 311 is initially coupled to piston 310, and shifting piston 310 from the position illustrated in FIG. 3A to the position illustrated in FIG. 3B also shears or decouples ball 311 from piston 310. After ball 311 is sheared or decoupled from piston 310, fluid or pressure is permitted to flow from second chamber 312 through third chamber 313 into pressure port 323, and through pressure port 323 into high-pressure chamber 230 of FIGS. 2A-2B. However, pressure or fluid flow from pressure port 323 into third chamber 311 shifts ball 311 onto a ball seat 333, thereby restricting or preventing pressure or fluid to flow out of high pressure chamber 230 out of third chamber 332, thereby maintaining a pressure differential between low-pressure chamber 215 and high-pressure chamber 230 to shift indexing piston 237 of FIGS. 2A-2B. More particularly, in the embodiment of FIGS. 2 and 3, a pressure differential between lower-pressure chamber 215 and high-pressure chamber 230 is not sufficient or is not maintained for a threshold amount of time to shift indexing piston 237 until after ball 311 is sheared or decoupled from piston 310 to restrict or prevent pressure or fluid to flow out of high pressure chamber 230 out of third chamber 332.

Figure 4:
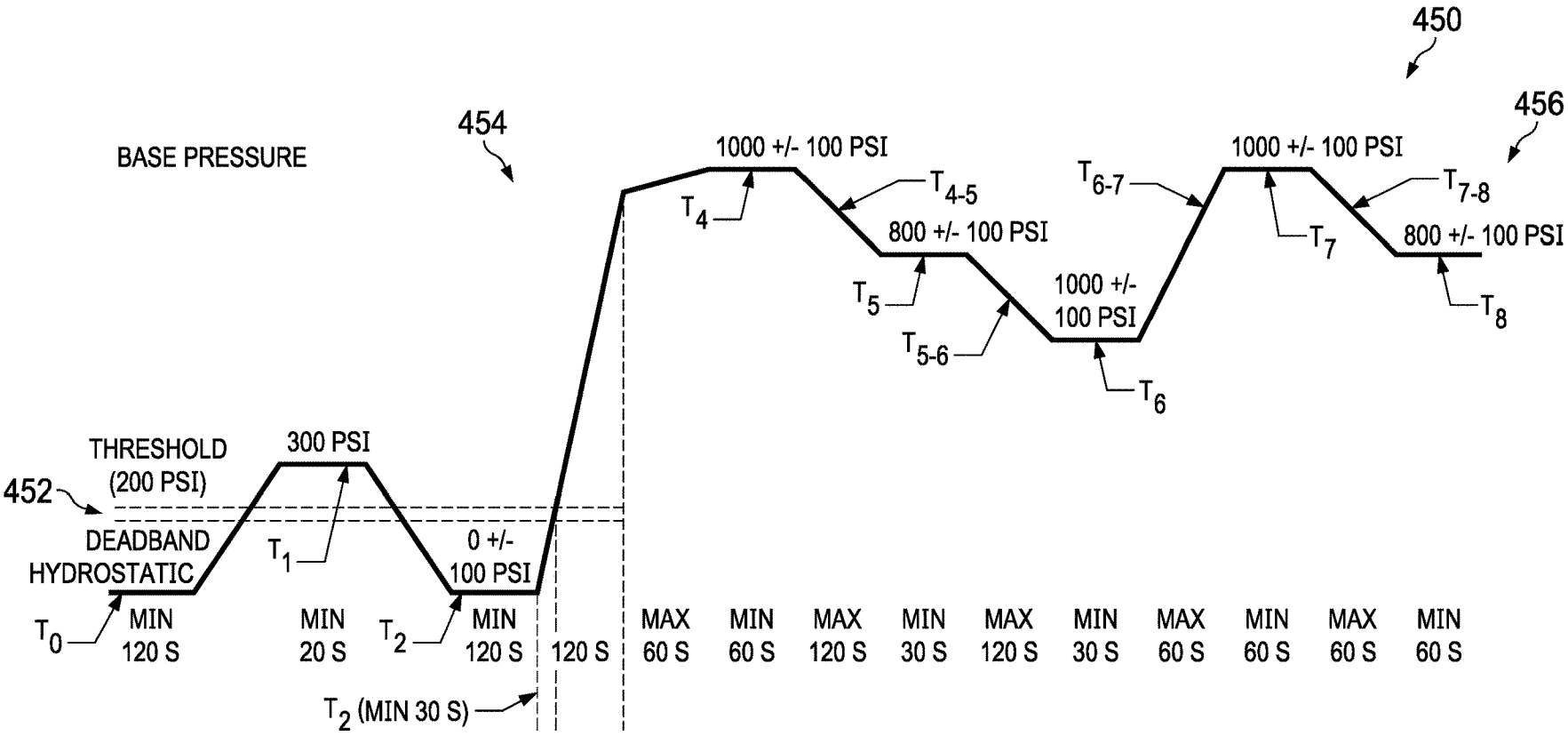
FIG. 4 is a graphical view of a time-dependent signature pressure profile to arm the pressure-activated valve assembly of FIGS. 2A-2B.

FIG. 4 is a graphical view of a time-dependent signature pressure profile to activate the remote-activated downhole system 275 and arm pressure-activated valve assembly 218 of FIGS. 2A-2B. In the embodiment of FIG. 4, each of the time and pressure values associated with pressure profile 450 is associated with a tolerance that is preprogramed into decoder 304 of FIGS. 3A-3B. Initially at time $T_0$, the pressure (e.g. pressure in the interior passageway of the pressure-activated valve assembly) is maintained at a hydrostatic pressure for a minimum of 120 seconds to establish a reference point for decoder 304. In some embodiments, pump 164 of FIG. 1 is operated to raise the pressure by a preselected threshold 452 for at least a minimum time interval $T_1$, e.g., of 20 seconds. As illustrated, threshold 452 is selected to be 200 psi above the hydrostatic pressure, but in other embodiments, the threshold may be higher or lower. After the time interval $T_1$, operation of pump 164 is discontinued to return the pressure to the hydrostatic reference for a minimum time interval $T_2$ of 120 seconds. In some embodiments, if the pressure is raised above the threshold for a second time within a time interval $T_3$, a preliminary portion of pressure profile 450 is complete. In some embodiments, if each of the required requirements of the preliminary portion 454 are satisfied and detected by pressure sensor 302 of FIGS. 3A-3B and decoder 304, decoder 304 is induced to respond in a desired manner. For example, decoder 304 increases a sample rate of pressure sensor 302 so that a secondary portion of the pressure profile is more accurately monitored.

In some embodiments, additional bits of information are added to the wireless signal to increase the confidence that the wireless signal is not accidentally sent from a variation in background noise or normal wellbore operations. In one or more of such embodiments, these additional bits of information consist of pressure changes and time durations over which the pressure changes are maintained. These additional bits of data are contained within a secondary portion 456 of pressure profile 450. As illustrated in FIG. 4, secondary portion 456 of pressure profile 450 includes an increase to a base pressure of 1,000 psi over time interval $T_4$, and subsequent reductions and increases of pressure in an incrementally stepped manner over time intervals $T_5$, $T_6$, $T_7$ and $T_8$. In some embodiments, Time intervals $T_4$, $T_5$, $T_6$, $T_7$ and $T_8$ are referred to as minimum time intervals since the specific pressure associated therewith, e.g., 1000 psi±100 psi for time interval $T_4$, is maintained for a minimum of the stated time, e.g., 60 seconds for time interval $T_4$. In some embodiments, the time intervals $T_4$, $T_5$, $T_6$, $T_7$ and $T_8$ last longer than stated time as long as the pressure is maintained between upper and lower tolerances. Interposed between the minimum time intervals $T_4$, $T_5$, $T_6$, $T_7$ and $T_8$, are maximum transition time intervals $T_{4-5}$, $T_{5-6}$, $T_{6-7}$ and $T_{7-8}$. The maximum transition time intervals $T_{4-5}$, $T_{5-6}$, $T_{6-7}$ and $T_{7-8}$ last no longer than the stated duration, e.g., 120 seconds for $T_{4-5}$, and represent the time permitted for transitioning between the pressure levels associated with the adjacent time intervals. For example, transition time interval $T_{4-5}$ may begin when the detected pressure falls below the lower tolerance of time interval $T_4$, e.g., falls below 900 psi, and end when the detected pressure reaches the upper tolerance of time interval $T_5$, e.g., 900 psi.

In some embodiments, when each of the pressures and time intervals of the pressure profile 450 are detected by pressure sensor 302, the signals from pressure sensor 302 are "decoded" by decoder 304 to establish a detected pressure profile. Decoder 304 correlates the pressure values to the time intervals and compares the detected pressure profile to the target profile stored therein. When a match is recognized between the detected and signature profiles, e.g., each of the pressures and time intervals of the detected pressure profile are within the tolerances associated with pressure profile 450, decoder 304 issues the command to pin pusher 306 of FIGS. 3A-3B or other actuation mechanism to puncture, break, or induce failure of fluid barrier 320 of FIGS. 3A-3B, thereby arming the pressure-activated valve assembly. While pressure profile 450 illustrated in FIG. 4 includes five (5) pressure steps in secondary portion 456, in some embodiments, a different number of pressure steps are employed.

Figure 5:
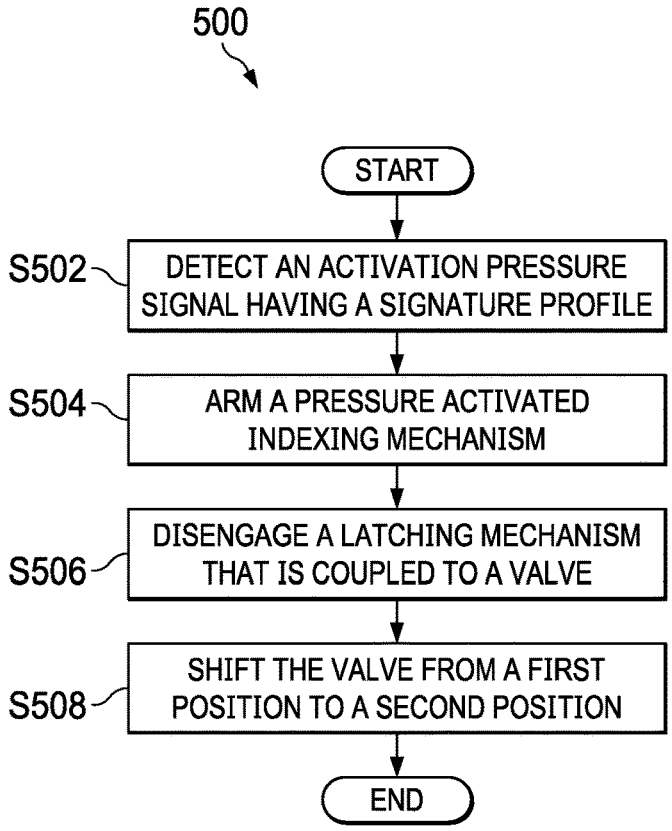
FIG. 5 is a flow chart of a process to remotely activate a valve.

FIG. 5 is a flow chart of a process to remotely activate a valve. Although the operations in process 500 are shown in a particular sequence, certain operations may be performed in different sequences or at the same time where feasible. At block S502, an activation pressure signal having a signal profile is detected. FIG. 3A, for example, illustrates a pressure sensor 302 that is configured to detect pressure signals. Further, decoder 304 of FIGS. 3A-3B is configured to determine whether any of the pressure signals contain a pressure profile that matches the signature pressure of the activation pressure signal.

At block S504, and in response to and after detecting the activation pressure signal, a pressure-activated indexing mechanism of the pressure-activated valve assembly is armed. In the embodiment of FIG. 3B for example, after decoder 304 detects the activation pressure signal, an actuation mechanism, such as pin pusher 306 is actuated to puncture, break, or induce failure of fluid barrier 320, which in turn shifts piston 310 from a first position illustrated in FIG. 3A to a second position illustrated in FIG. 3B. Additional descriptions of operations performed to arm the pressure-activated indexing mechanism are provided herein and are illustrated in at least FIGS. 3A-3B. At block S506, after the pressure-activated indexing mechanism is armed, and after at least one cycle of threshold pressure is applied to the pressure-activated indexing mechanism, a latch mechanism of the pressure-activated valve assembly is disengaged. In the embodiment of FIGS. 2A-2B, a threshold of cycles of differential pressure are applied to indexing piston 237 to shift indexing mandrel 240 by a threshold of increments. Further, shifting indexing mandrel 240 by the threshold number of increments in turn disengages latch 242 from indexing mandrel 240. In some embodiments, at least one cycles of threshold pressure is applied to the pressure-activated indexing mechanism immediately or soon after (e.g., within a minute, an hour, a day, or another period of time) the pressure-activated indexing mechanism is armed. In some embodiments, at least one cycles of threshold pressure is applied to the pressure-activated indexing mechanism long after (e.g., a week, a month, a year, several years, or another period of time) the pressure-activated indexing mechanism is armed.

At block S508, the valve of the pressure-activated valve assembly is shifted from a first position to a second position. Continuing with the foregoing description of FIGS. 2A-2B, latch 242 holds spring 255 in a compressed state while latch 242 is engaged to indexing mandrel 240. However, spring 255 returns to a natural state after latch 242 disengages from indexing mandrel 240. Further, force released by spring 255 returning to the natural state in turn shifts mandrel 257 (or profile section 259) from the position illustrated in FIGS. 2A-2B to a second position (not shown). Mandrel 257 is coupled to ball 219 such that shifting mandrel 257 (or profile section 259) from the position illustrated in FIGS. 2A-2B to the second position also shifts, rotates, or moves ball 219 from a closed position illustrated in FIGS. 2A-2B to an open position (not shown).

Figure 6:
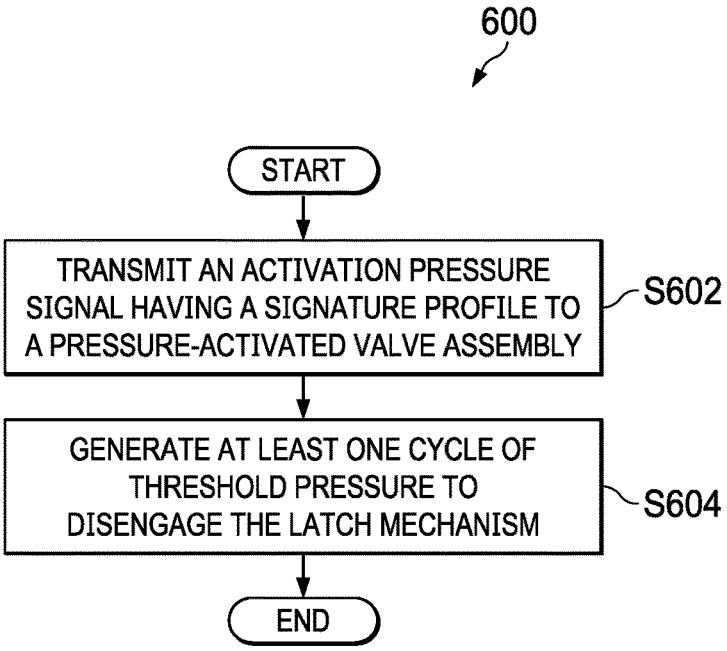
FIG. 6 is a flow chart of another processor to remotely activate a valve.

FIG. 6 is a flow chart of another processor to remotely activate a valve. Although the operations in process 600 are shown in a particular sequence, certain operations may be performed in different sequences or at the same time where feasible. At block S602, an activation pressure signal having a signature profile is transmitted to a pressure-activated-valve assembly. FIG. 1 for example, illustrates transmitting the activation pressure signal via pump 164 downhole to pressure-activated-valve assembly 118. The pressure-activated valve assembly includes a valve, a latch mechanism that is configured to shift the valve to an open position, a pressure-activated indexing mechanism that is initially engaged to the latch mechanism, and a remote-activated downhole system that is configured to receive the activation pressure signal, and in response to receiving the activation pressure signal, arm the pressure-activated index mechanism. In that regard, FIGS. 2A-2B illustrate pressure-activated valve assembly 218 having a ball valve, latch mechanism 295, pressure-activated indexing mechanism 285, and remote-activated downhole system 275. FIGS. 3A-3B illustrate additional components of remote-activated downhole system 275. At block S604, and after transmitting the pressure signal, at least one cycle of threshold pressure is generated to disengage the latch mechanism. Further, the latch mechanism shifts or causes the valve to shift to the open position after the latch mechanism disengages from the pressure-activated indexing mechanism.

The above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. The scope of the claims is intended to broadly cover the disclosed embodiments and any such modification. Further, the following clauses represent additional embodiments of the disclosure and should be considered within the scope of the disclosure:

As used herein, the singular forms "a," "an," and "the" are intended to include the plural forms as well, unless the context clearly indicates otherwise. It will be further understood that the terms "comprise" and/or "comprising," when used in this specification and/or in the claims, specify the presence of stated features, steps, operations, elements, and/or components, but do not preclude the presence or addition of one or more other features, steps, operations, elements, components, and/or groups thereof. In addition, the steps and components described in the above embodiments and figures are merely illustrative and do not imply that any particular step or component is a requirement of a claimed embodiment.

Clause 1, a pressure-activated valve assembly, comprising: a valve; a latch mechanism configured to shift the valve to an open position; a pressure-activated indexing mechanism that is initially engaged to the latch mechanism, wherein the pressure-activated indexing mechanism is initially in an unarmed mode, and wherein after the pressure-activated indexing mechanism is in an armed mode, applying at least one cycle of threshold pressure to the pressure-activated indexing mechanism disengages the latch mechanism to shift the valve to the open position; and a remote-activated downhole system configured to: receive an activation pressure signal having a signature profile; and in response to receiving the activation pressure signal, arm the pressure-activated indexing mechanism.

Clause 2, the pressure-activated valve assembly of clause 1, wherein the remote-activated downhole system comprises a sensor configured to detect the activation pressure signal, wherein the pressure-activated indexing mechanism is armed after the sensor detects the activation pressure signal.

Clause 3, the pressure-activated valve assembly of clause 2, wherein the remote-activated downhole system further comprises a detector configured to: compare a signature profile of a pressure signal detected by the sensor with the signature profile of the activation pressure signal; and determine whether the signature profile of the pressure signature matches the signature profile of the activation pressure signal, wherein in response to a determination that the signature profile of the pressure signature matches the signature profile of the activation pressure signal, the remote-activated downhole system arms the pressure-activated index mechanism.

Clause 4, the pressure-activated valve assembly of clause 3, further comprising: a chamber having an actuator fluid; a fluid barrier that prevents the actuator fluid from flowing through the fluid barrier while the fluid barrier is intact; and an actuation mechanism configured to move from a first position to a second position to puncture the fluid barrier, wherein the pressure-activated index mechanism is armed after the actuation mechanism shifts from the first position to the second position to puncture the fluid barrier.

Clause 5, the pressure-activated valve assembly of clause 4, further comprising a piston that is initially positioned in a first position while the fluid barrier is intact and configured to shift from the first position to a second position after the fluid barrier is punctured, wherein the pressure-activated index mechanism is armed after the piston shifts from the first position to the second position.

Clause 6, the pressure-activated valve assembly of clause 5, wherein the piston is coupled to the pressure-activated indexing mechanism, and wherein the piston arms the pressure-activated index mechanism as the piston shifts from the first position to the second position.

Clause 7, the pressure-activated valve assembly of any of clauses 1-6, wherein the signature profile of the activation pressure signal comprises plurality of minimum time intervals over which an incrementally-stepped plurality of pressure levels is maintained between a first tolerance threshold and a second tolerance threshold.

Clause 8, the pressure-activated valve assembly of clause 7, wherein at least one maximum time interval is interposed between the plurality of minimum time intervals of the incrementally-stepped plurality of pressure levels.

Clause 9, the pressure-activated valve assembly of any of clauses 1-8, wherein the latch mechanism comprises: a latch that is initially engaged to the pressure-activated indexing mechanism; and a spring that is in a compressed state while the latch is engaged to the pressure-activated indexing mechanism, and reverts to a natural state after the latch disengages from the pressure-activated indexing mechanism, wherein a force generated by the spring reverting from the compressed state to the natural state shifts the valve to the open position.

Clause 10, the pressure-activated valve assembly of clause 9, wherein the latch mechanism further comprises a mandrel that is coupled to the spring, wherein the force generated by the spring reverting from the compressed state moves the mandrel from a first position to a second position, and wherein the mandrel shifts the valve to the open position as the mandrel moves from the first position to the second position.

Clause 11, the pressure-activated valve assembly of any of clauses 1-10, wherein the pressure-activated indexing mechanism comprises a indexing piston configured to shift from a first position to a second position in response to the threshold pressure being applied to the indexing piston, and shift from the second position to the first position in response to less than the threshold pressure being applied to the indexing piston, and wherein shifting the pressure-activated piston from the first position to the second position for a threshold number of times disengages the latch mechanism from the pressure-activated indexing mechanism.

Clause 12, the pressure-activated valve of assembly of clause 11, wherein the pressure-activated indexing mechanism further comprises: a first chamber filled with a fluid having a first pressure; and a second chamber filled with the fluid having a second pressure that is higher than the first pressure, wherein the threshold pressure applied to the indexing piston is generated by a pressure differential between the first pressure and the second pressure that is greater than or equal to the threshold pressure.

Clause 13, the pressure-activated valve assembly of any of clauses 1-12, wherein the valve is a ball valve.

Clause 14, a method to remotely activate a valve, comprising: transmitting an activation pressure signal having a signature profile to a pressure-activated valve assembly, the pressure-activated valve assembly comprising: a valve; a latch mechanism configured to shift the valve to an open position; a pressure-activated indexing mechanism that is initially engaged to the latch mechanism; and a remote-activated downhole system configured to: receive the activation pressure signal having a signature profile; and in response to receiving the activation pressure signal, arm the pressure-activated indexing mechanism; and after transmitting the activation pressure signal, generating at least one cycle of threshold pressure to disengage the latch mechanism, wherein the latch mechanism causes valve to shift to the open position after the latch mechanism is disengaged from the pressure-activated indexing mechanism.

Clause 15, the method of clause 14, wherein transmitting the activation pressure signal comprises transmitting a pressure signal having a signal profile that comprises a plurality of minimum time intervals over which an incrementally-stepped plurality of pressure levels is maintained between a first tolerance threshold and a second tolerance threshold.

Clause 16, the method of clause 15, wherein at least one maximum time interval is interposed between the plurality of minimum time intervals of the incrementally-stepped plurality of pressure levels.

Clause 17, a method to remotely activate a valve, comprising: detecting an activation pressure signal having a signature profile; in response to and after detecting the activation pressure signal, arming a pressure-activated indexing mechanism; after the pressure-activated indexing mechanism is armed, and after at least one cycle of threshold pressure is applied to the pressure-activated indexing mechanism, disengaging a latch mechanism that is coupled to a valve; and shifting the valve from a first position to a second position to open the valve.

Clause 18, the method of clause 17, further comprising: in response to and after detecting the activation pressure signal, shifting an actuation mechanism from a first position to a second position to puncture a fluid barrier, wherein pressure-activated indexing mechanism is armed after the fluid barrier is punctured.

Clause 19, the method of clause 18, further comprising: after puncturing the fluid barrier, shifting a piston that is coupled to the pressure-activated indexing mechanism from a first position to a second position to arm the pressure-activated indexing mechanism.

Clause 20, the method of any of clauses 17-19, further comprising inducing a threshold pressure differential that is equal to the threshold pressure to apply a cycle of the at least one cycle of threshold pressure to the pressure-activated index mechanism.

Arrows indicating directions of fluid flow are illustrated for illustration purposes only. It is understood that fluids may flow in additional directions not shown in the Figures. As used herein, the singular forms "a", "an" and "the" are intended to include the plural forms as well, unless the context clearly indicates otherwise. It will be further understood that the terms "comprise" and/or "comprising," when used in this specification and/or the claims, specify the presence of stated features, steps, operations, elements, and/or components, but do not preclude the presence or addition of one or more other features, steps, operations, elements, components, and/or groups thereof. In addition, the steps and components described in the above embodiments and figures are merely illustrative and do not imply that any particular step or component is a requirement of a claimed embodiment.

What is claimed is:

1. A pressure-activated valve assembly, comprising:

a valve;

a latch mechanism configured to shift the valve to an open position;

a pressure-activated indexing mechanism that is initially engaged to the latch mechanism, wherein the pressure-activated indexing mechanism is initially in an unarmed mode, and wherein after the pressure-activated indexing mechanism is in an armed mode, applying at least one cycle of threshold pressure to the pressure-activated indexing mechanism disengages the latch mechanism to shift the valve to the open position; and a remote-activated downhole system configured to:

receive an activation pressure signal having a signature profile; and in response to receiving the activation pressure signal, arm the pressure-activated indexing mechanism.

2. The pressure-activated valve assembly of claim 1, wherein the remote-activated downhole system comprises a sensor configured to detect the activation pressure signal, wherein the pressure-activated indexing mechanism is armed after the sensor detects the activation pressure signal.

3. The pressure-activated valve assembly of claim 2, wherein the remote-activated downhole system further comprises a detector configured to:

compare a signature profile of a pressure signal detected by the sensor with the signature profile of the activation pressure signal; and determine whether the signature profile of the pressure signal detected by the sensor matches the signature profile of the activation pressure signal, wherein in response to a determination that the signature profile of the pressure signal detected by the sensor matches the signature profile of the activation pressure signal, the remote-activated downhole system arms the pressure-activated index mechanism.

4. The pressure-activated valve assembly of claim 3, further comprising:

a chamber having an actuator fluid;

a fluid barrier that prevents the actuator fluid from flowing through the fluid barrier while the fluid barrier is intact; and an actuation mechanism configured to move from a first position to a second position to puncture the fluid barrier, wherein the pressure-activated index mechanism is armed after the actuation mechanism shifts from the first position to the second position to puncture the fluid barrier.

5. The pressure-activated valve assembly of claim 4, further comprising a piston that is initially positioned in a first position while the fluid barrier is intact and configured to shift from the first position to a second position after the fluid barrier is punctured, wherein the pressure-activated index mechanism is armed after the piston shifts from the first position to the second position.

6. The pressure-activated valve assembly of claim 5, wherein the piston is coupled to the pressure-activated indexing mechanism, and wherein the piston arms the pressure-activated index mechanism as the piston shifts from the first position to the second position.

7. The pressure-activated valve assembly of claim 1, wherein the signature profile of the activation pressure signal comprises plurality of minimum time intervals over which an incrementally-stepped plurality of pressure levels is maintained between a first tolerance threshold and a second tolerance threshold.

8. The pressure-activated valve assembly of claim 7, wherein at least one maximum time interval is interposed between the plurality of minimum time intervals of the incrementally-stepped plurality of pressure levels.

9. The pressure-activated valve assembly of claim 1, wherein the latch mechanism comprises:

a latch that is initially engaged to the pressure-activated indexing mechanism; and a spring that is in a compressed state while the latch is engaged to the pressure-activated indexing mechanism, and reverts to a natural state after the latch disengages from the pressure-activated indexing mechanism, wherein a force generated by the spring reverting from the compressed state to the natural state shifts the valve to the open position.

10. The pressure-activated valve assembly of claim 9, wherein the latch mechanism further comprises a mandrel that is coupled to the spring, wherein the force generated by the spring reverting from the compressed state moves the mandrel from a first position to a second position, and wherein the mandrel shifts the valve to the open position as the mandrel moves from the first position to the second position.

11. The pressure-activated valve assembly of claim 1, wherein the pressure-activated indexing mechanism comprises a indexing piston configured to shift from a first position to a second position in response to the threshold pressure being applied to the indexing piston, and shift from the second position to the first position in response to less than the threshold pressure being applied to the indexing piston, and wherein shifting the pressure-activated piston from the first position to the second position for a threshold number of times disengages the latch mechanism from the pressure-activated indexing mechanism.

12. The pressure-activated valve of assembly of claim 11, wherein the pressure-activated indexing mechanism further comprises:

a first chamber filled with a fluid having a first pressure; and a second chamber filled with the fluid having a second pressure that is higher than the first pressure, wherein the threshold pressure applied to the indexing piston is generated by a pressure differential between the first pressure and the second pressure that is greater than or equal to the threshold pressure.

13. The pressure-activated valve assembly of claim 1, wherein the valve is a ball valve.

14. A method to remotely activate a valve, comprising:

transmitting an activation pressure signal having a signature profile to a pressure-activated valve assembly, the pressure-activated valve assembly comprising:

a valve;

a latch mechanism configured to shift the valve to an open position;

a pressure-activated indexing mechanism that is initially engaged to the latch mechanism; and a remote-activated downhole system configured to:

receive the activation pressure signal having the signature profile; and in response to receiving the activation pressure signal, arm the pressure-activated indexing mechanism; and after transmitting the activation pressure signal, generating at least one cycle of threshold pressure to disengage the latch mechanism, wherein the latch mechanism causes valve to shift to the open position after the latch mechanism is disengaged from the pressure-activated indexing mechanism.

15. The method of claim 14, wherein transmitting the activation pressure signal comprises transmitting a pressure signal having a signal profile that comprises a plurality of minimum time intervals over which an incrementally-stepped plurality of pressure levels is maintained between a first tolerance threshold and a second tolerance threshold.

16. The method of claim 15, wherein at least one maximum time interval is interposed between the plurality of minimum time intervals of the incrementally-stepped plurality of pressure levels.

17. A method to remotely activate a valve, comprising:

detecting an activation pressure signal having a signature profile;

in response to and after detecting the activation pressure signal, arming a pressure-activated indexing mechanism;

after the pressure-activated indexing mechanism is armed, and after at least one cycle of threshold pressure is applied to the pressure-activated indexing mechanism, disengaging a latch mechanism that is coupled to a valve; and shifting the valve from a first position to a second position to open the valve.

18. The method of claim 17, further comprising:

in response to and after detecting the activation pressure signal, shifting an actuation mechanism from a first position to a second position to puncture a fluid barrier, wherein pressure-activated indexing mechanism is armed after the fluid barrier is punctured.

19. The method of claim 18, further comprising:

after puncturing the fluid barrier, shifting a piston that is coupled to the pressure-activated indexing mechanism from a first position to a second position to arm the pressure-activated indexing mechanism.

20. The method of claim 17, further comprising inducing a threshold pressure differential that is equal to the threshold pressure to apply a cycle of the at least one cycle of threshold pressure to the pressure-activated index mechanism.

* * * * *